US009670042B2

(12) United States Patent
Liou

(10) Patent No.: US 9,670,042 B2
(45) Date of Patent: Jun. 6, 2017

(54) TOOL HEAD MULTIFUNCTIONAL TOOL

(71) Applicant: Mou-Tang Liou, Taichung (TW)

(72) Inventor: Mou-Tang Liou, Taichung (TW)

( * ) Notice: Subject to any disclaimer, the term of this patent is extended or adjusted under 35 U.S.C. 154(b) by 343 days.

(21) Appl. No.: 14/522,628

(22) Filed: Oct. 24, 2014

(65) Prior Publication Data

US 2016/0115007 A1 Apr. 28, 2016

(51) Int. Cl.
*B66F 15/00* (2006.01)
*B25F 1/00* (2006.01)

(52) U.S. Cl.
CPC ..... *B66F 15/00* (2013.01); *B25F 1/00* (2013.01); *B25F 1/006* (2013.01)

(58) Field of Classification Search
CPC .. B25F 1/00; B25F 1/006; B66F 15/00; B25B 13/48
USPC ..... 7/166
See application file for complete search history.

(56) References Cited

U.S. PATENT DOCUMENTS 563,848 A * 7/1896 Dunham ..... B25B 13/48 7/138
4,826,136 A * 5/1989 Thomas ..... B25F 1/00 254/131
D577,274 S * 9/2008 Chen ..... D8/81
7,774,882 B2 8/2010 Liou
8,024,994 B2 * 9/2011 St. John ..... E04G 23/08 362/120
2004/0261188 A1 * 12/2004 Mathis ..... B25D 1/00 7/145
2006/0075572 A1 * 4/2006 Young ..... B25B 13/48 7/138

* cited by examiner

*Primary Examiner* — Hadi Shakeri
(74) *Attorney, Agent, or Firm* — Alan D. Kamrath; Kamrath IP Lawfirm, P.A.

(57) ABSTRACT

A multifunctional tool includes a tool head including first, second, third jaws, and first and second engaging spaces. The first engaging space extends between the first and second jaws. The second engaging space extends between the third jaw and a surface facing the third jaw. The first engaging space has first, second, and third lengths defining a maximum space between first sections, a minimum space between second sections, and a minimum space between third sections of the first and second jaws, respectively. The second length is shorter than the first length. The third length is longer than the second length but shorter than the first length. The second engaging space has a fourth length defining a space between the third jaw and the surface. The fourth length is not shorter than the third length.

15 Claims, 10 Drawing Sheets

TOOL HEAD MULTIFUNCTIONAL TOOL

BACKGROUND OF THE INVENTION

1. Field of the Invention

The present invention relates to a multifunctional tool and, particularly, to a tool head of the multifunctional tool.

2. Description of the Related Art

U.S. Pat. No. 7,774,882 shows a multifunctional tool. The multifunctional tool has a shank body including a first end, a second end and a plurality of positioning grooves formed between the first and second ends thereof. A pry bar includes a connected section and a working section extending from a side of the connected section for pulling nails. A through-hole pierces the connected section for slidably receiving the shank body, with a second receptacle piercing the connected section and in communication with the through-hole. A clutch is disposed in the second receptacle for alternatively engaging with a selected one of the positioning grooves.

However, it is still desirable to improve such multifunctional tool so that it is versatile and can be used as a pry bar or even a survival tool.

The present invention is, therefore, intended to obviate or at least alleviate the problems encountered in the prior art.

SUMMARY OF THE INVENTION

According to the present invention, a multifunctional tool includes a handle bar. The handle bar defines a working end. A tool head connects to the working end of the handle bar and includes a connecting hole extending along a phantom axis and receiving the working end. The tool head has first and second ends on opposite ends of the phantom axis. The tool head includes the first end thereof being adjacent to a first jaw and the second end thereof being adjacent to a second jaw, respectively. The tool head includes the first jaw extending away from the phantom axis and along a first phantom line which extends transversely to the phantom axis. The tool head includes the second jaw facing the first jaw and extending away from the phantom axis and along a second phantom line which extends parallel to the first phantom line and transversely to the phantom axis. The tool head includes a third jaw having a first structure extending away from the phantom axis and along a third phantom line and a second structure extending from the first structure and along a fourth phantom line which extends transversely to the third phantom line. The tool head includes a first engaging space extending between the first and second jaws and being adjacent to an edge of the first jaw which has first, second, third, and fourth sections disposed one after another along the first phantom line and an edge of the second jaw which has first, second, and third sections disposed one after another along the second phantom line. The first and second jaws include the respective first sections thereof being adjacent to the phantom axis and facing one another and forming a recess individually. The first and second jaws include the respective second sections thereof facing one another and forming a flat protrusion individually. The first and second jaws include the respective third sections thereof facing one another. The first jaw includes the edge thereof having a distal end distal to the phantom axis at a first distance. The second jaw includes the edge thereof having a distal end distal to the phantom axis at a second distance which is shorter than the first distance. The first engaging space has first, second, and third lengths. The first engaging space includes the first length thereof defining a maximum space between the first sections of the respective first and second jaws, the second length thereof defining a minimum space between the second sections of the respective first and second jaws, and the third length thereof defining a minimum space between the third sections of the respective first and second jaws. The second length is shorter than the first length. The third length is longer than the second length but shorter than the first length. The tool head includes a second engaging space extending between a first surface which is defined on an edge of the second structure of the third jaw and a second surface which faces the first surface. The second engaging space has a fourth length. The second engaging space includes the fourth length thereof defining a space between the first and second surfaces. The fourth length is not shorter than the third length.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide an improved multifunctional tool that is versatile and can be used as a pry bar or even a survival tool.

Other objectives, advantages, and new features of the present invention will become apparent from the following detailed description of the invention when considered in conjunction with the accompanied drawings.

DETAILED DESCRIPTION OF THE INVENTION

Figure 1:
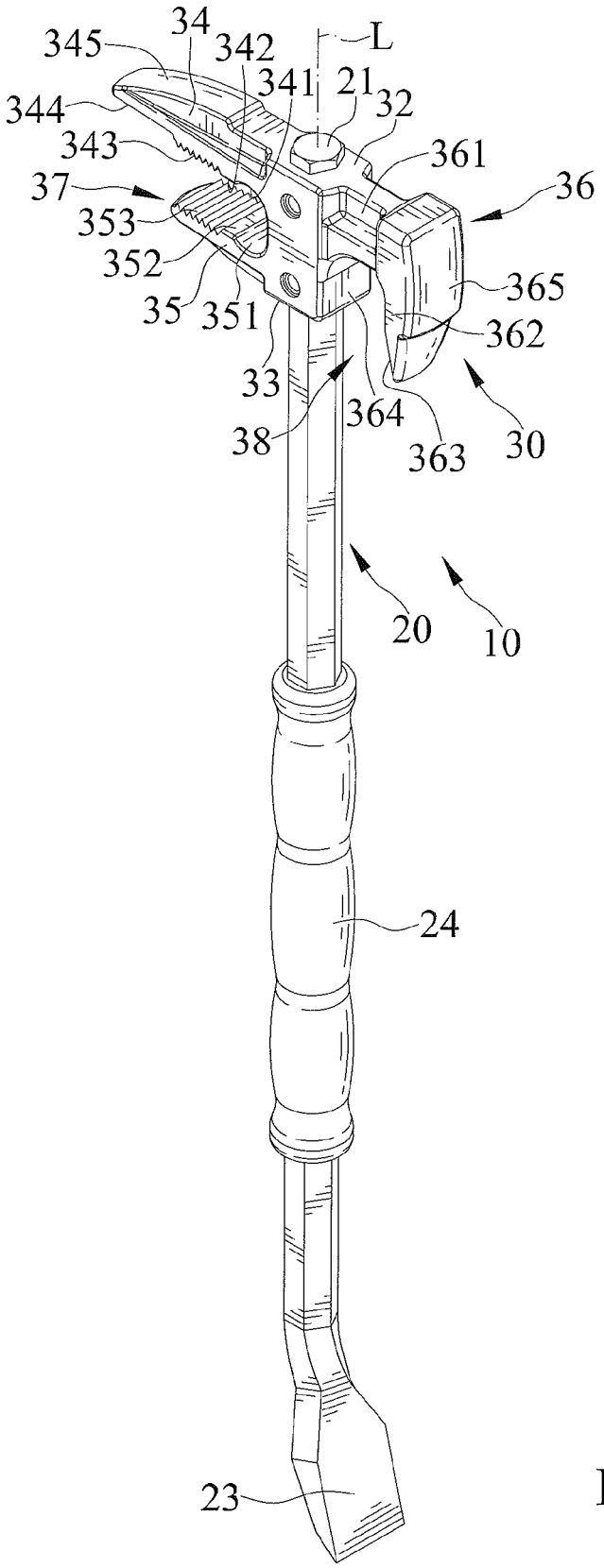
FIG. 1 is a perspective view of a multifunctional tool in accordance with the present invention.
Figure 2:
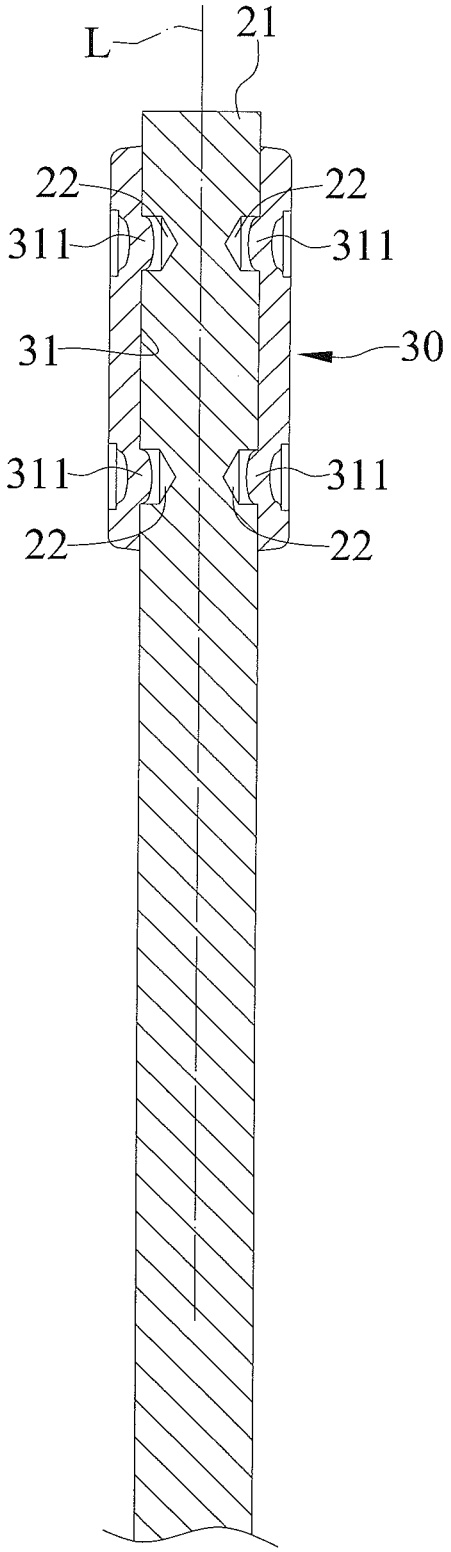
FIG. 2 is a partial, cross-sectional view of the multifunctional tool of the present invention.
Figure 3:
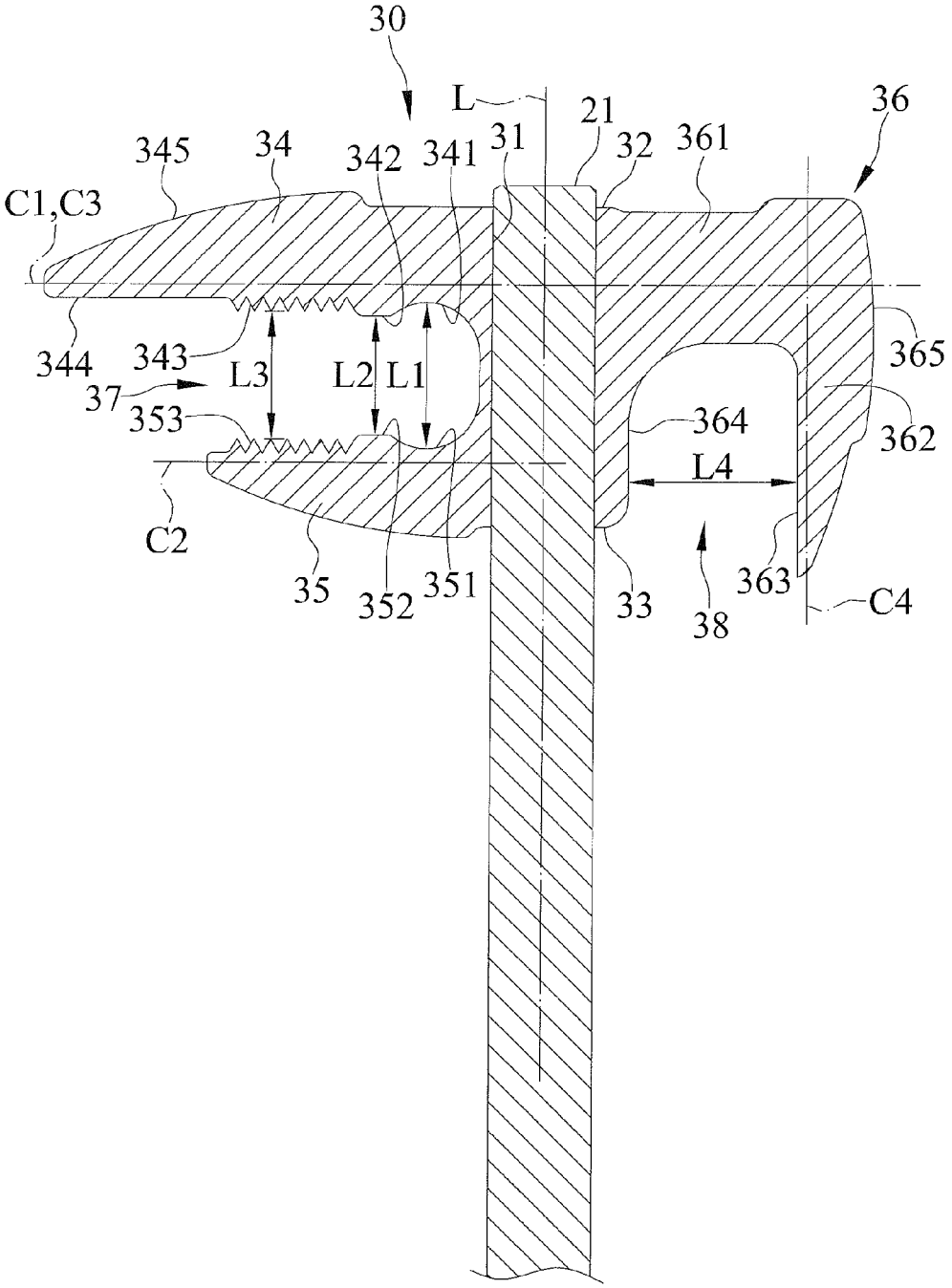
FIG. 3 is a partial, cross-sectional view of the multifunctional tool of the resent invention.

FIGS. 1 through 10 show a multifunctional tool 10 in accordance with the present invention. The multifunctional tool 10 includes a handle bar 20 and a tool head 30.

The handle bar 20 defines a working end 21. The handle bar 20 has an end thereof, which is opposite to the working end 21, forming a tool end 23. The tool end 23 includes a wedged structural end. The tool end 23 and the handle bar 20 are integral and made from the same material.

The tool head 30 connects to the working end 21 of the handle bar 20 and includes a connecting hole 31 extending along a phantom axis L and receiving the working end 21. The handle bar 20 includes the working end 21 thereof protruding outside a first end of the connecting hole 31 of the tool head 30. The handle bar 20 and the tool head 30 are securely engaged with each other. The handle bar 20 includes at least one cavity 22, and the tool head 30 includes at least one protruded joint 311 engaging in the cavity 22 and the connecting hole 31. The at least one cavity 22 and the at least one protruded joint 311 extend radially to the phantom axis L. The handle bar 20 includes a longitudinal length protruding outside a second end of the connecting hole 31 of the tool head 30 and includes a grip section 24. A user can hold the grip section 24 to operate the multifunctional tool 10.

The tool head 30 has first and second ends 32 and 33 on opposite ends of the phantom axis L. The tool head 30 includes the first end 32 thereof being adjacent to a first jaw 34 and the second end 33 thereof being adjacent to a second jaw 35 respectively. The tool head 30 includes the first jaw 34 extending away from the phantom axis L and along a first phantom line C1 which extends transversely to the phantom axis L. The tool head 30 includes the second jaw 35 facing the first jaw 34 and extending away from the phantom axis L and along a second phantom line C2 which extends parallel to the first phantom line C1 and transversely to the phantom axis L. The tool head 30 includes a third jaw 36 having a first structure 361 extending away from the phantom axis L and along a third phantom line C3 and a second structure 362 extending from the first structure 361 and along a fourth phantom line C4 which extends transversely to the third phantom line C3. The second structure 362 of the third jaw 36 has an edge thereof, which is opposite to the edge defining the first surface 363, and includes a protruded area 365 and a slope extending along the fourth phantom axis C4 and from the protruded area 365 towards the first surface 363 in a direction away from the first structure 361 of the third jaw 36.

The tool head 30 includes a first engaging space 37 extending between the first and second jaws 34 and 35 and being adjacent to an edge of the first jaw 34 which has first, second, third, and fourth sections 341, 342, 343, and 344 disposed one after another along the first phantom line C1 and being adjacent to an edge of the second jaw 35 which has first, second, and third sections 351, 352, and 353 disposed one after another along the second phantom line C2. The first and second jaws 34 and 35 include the respective first sections 341 and 351 thereof being adjacent to the phantom axis L and facing one another and forming a recess individually. The first and second jaws 34 and 35 include the respective second sections 342 and 352 thereof facing one another and forming a flat protrusion individually. The first and second jaws 34 and 35 include the respective third sections 343 and 353 thereof facing one another. The first jaw 34 includes the edge thereof having a distal end distal to the phantom axis L at a first distance. The second jaw 35 includes the edge thereof having a distal end distal to the phantom axis L at a second distance which is shorter than the first distance. The first engaging space 37 has first, second, and third lengths L1, L2, and L3. The first engaging space 37 includes the first length L1 thereof defining a maximum space between the first sections 341 and 351 of the respective first and second jaws 34 and 35, the second length L2 thereof defining a minimum space between the second sections 342 and 352 of the respective first and second jaws 34 and 35, and the third length L3 thereof defining a minimum space between the third sections 343 and 353 of the respective first and second jaws 34 and 35. The second length L2 is shorter than the first length L1. The third length L3 is longer than the second length L2 but shorter than the first length L1. The second length L2 is 19 millimeters. The third length L3 is 25 millimeters. The first and second jaws 34 and 35 include the respective first sections 341 and 351 thereof having a concave shape. The first and second jaws 34 and 35 include the respective second sections 342 and 352 thereof being parallel to one another. The first jaw 34 includes the third section 343 thereof forming a serrated protrusion which includes a plurality of teeth disposed one after another along the first phantom line C1. The second jaw 35 includes the third section 353 thereof forming a serrated protrusion which includes a plurality of teeth disposed one after another along the second phantom line C2. The first jaw 34 includes an edge, which is opposite the edge forming the first, second, third, and fourth sections 341, 342, 343, and 344, defining a fifth section 345 extending curvedly along the first phantom line C1 and towards the fourth section 344 in a direction away from the phantom axis L.

The tool head 30 includes a second engaging space 38 extending between a first surface 363 which is defined on an edge of the second structure 362 of the third jaw 36 and a second surface 364 which faces the first surface 363. The second engaging space 38 has a fourth length L4. The second engaging space 38 includes the fourth length L4 thereof defining a space between the first and second surfaces 363 and 364. The fourth length L4 is not shorter than the third length L3. The fourth length L4 is 28 millimeters.

Figure 4:
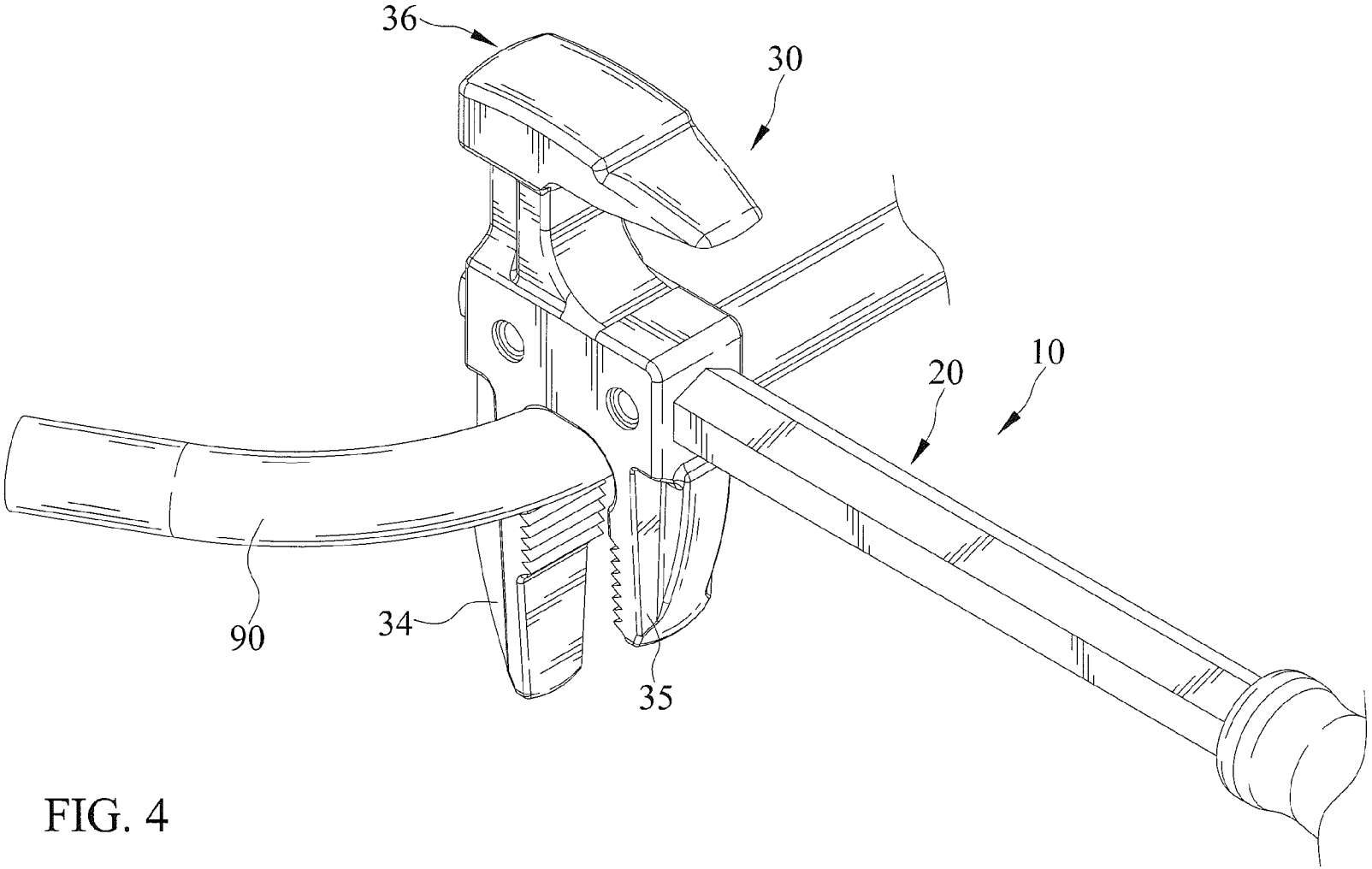
FIG. 4 is a perspective view showing the multifunctional tool of the present invention in a use to bend a rebar.
Figure 5:
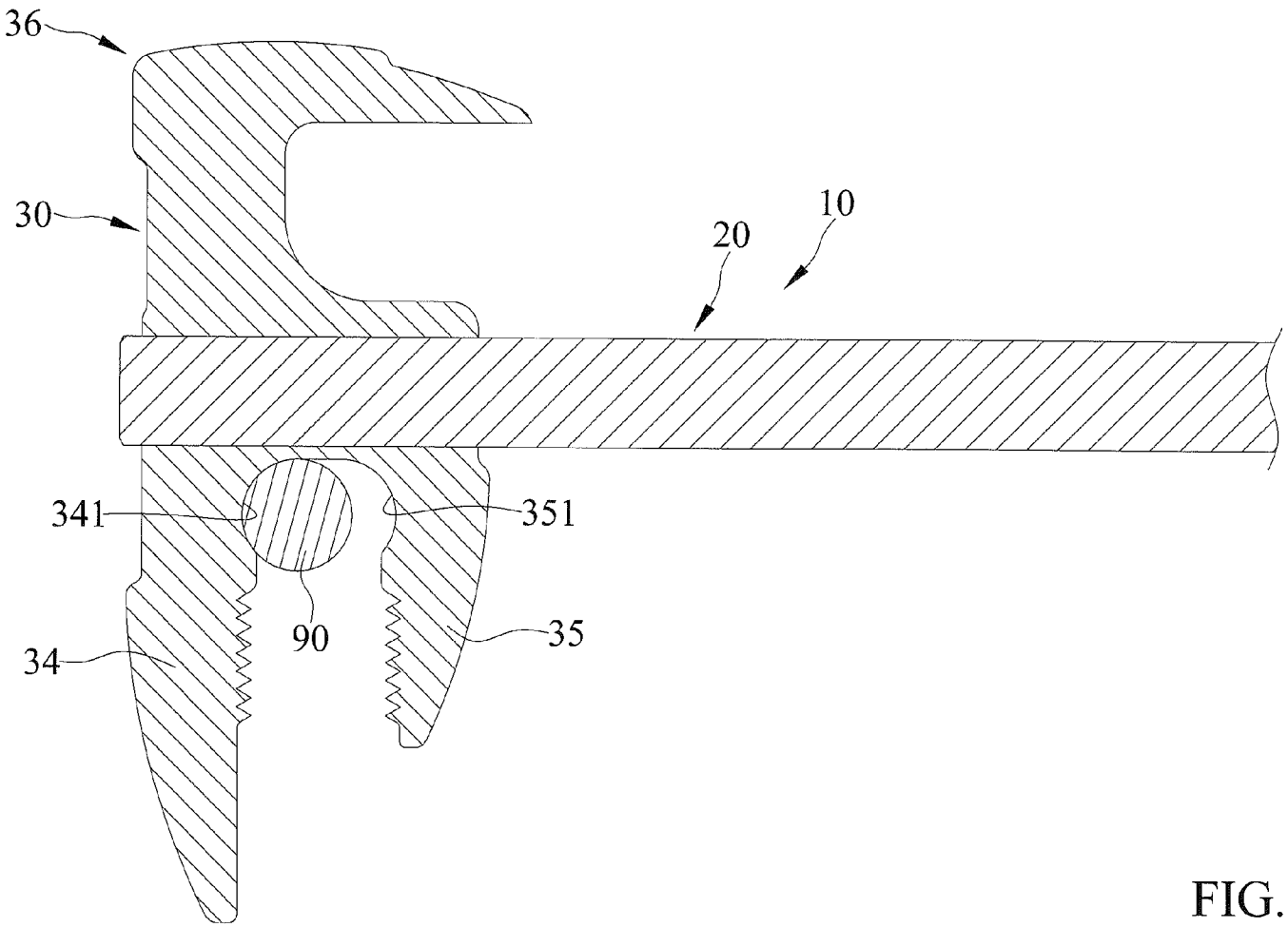
FIG. 5 is a cross-sectional view of FIG. 4.
Figure 6:
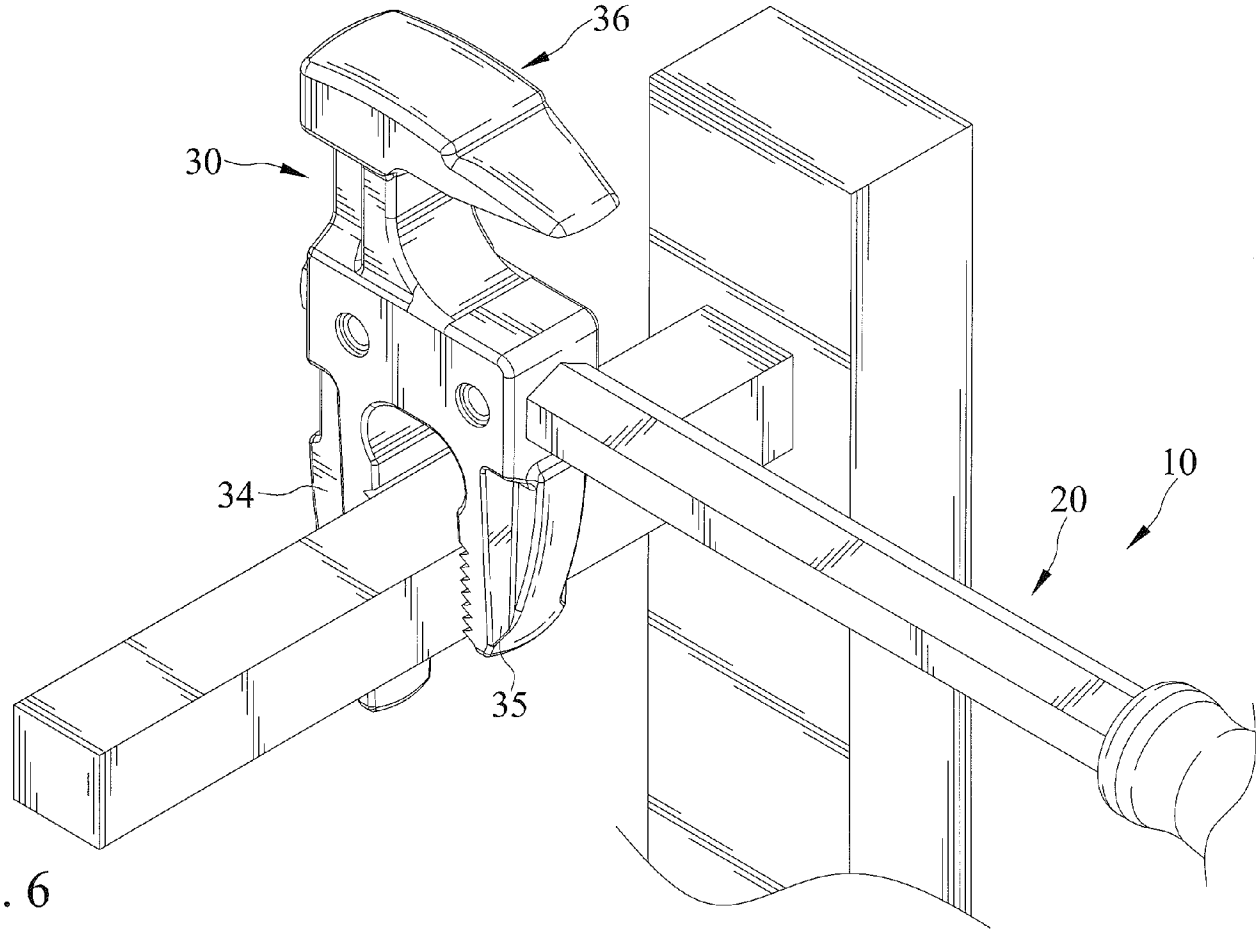
FIG. 6 is a perspective view showing the multifunctional tool of the present invention in another use.
Figure 7:
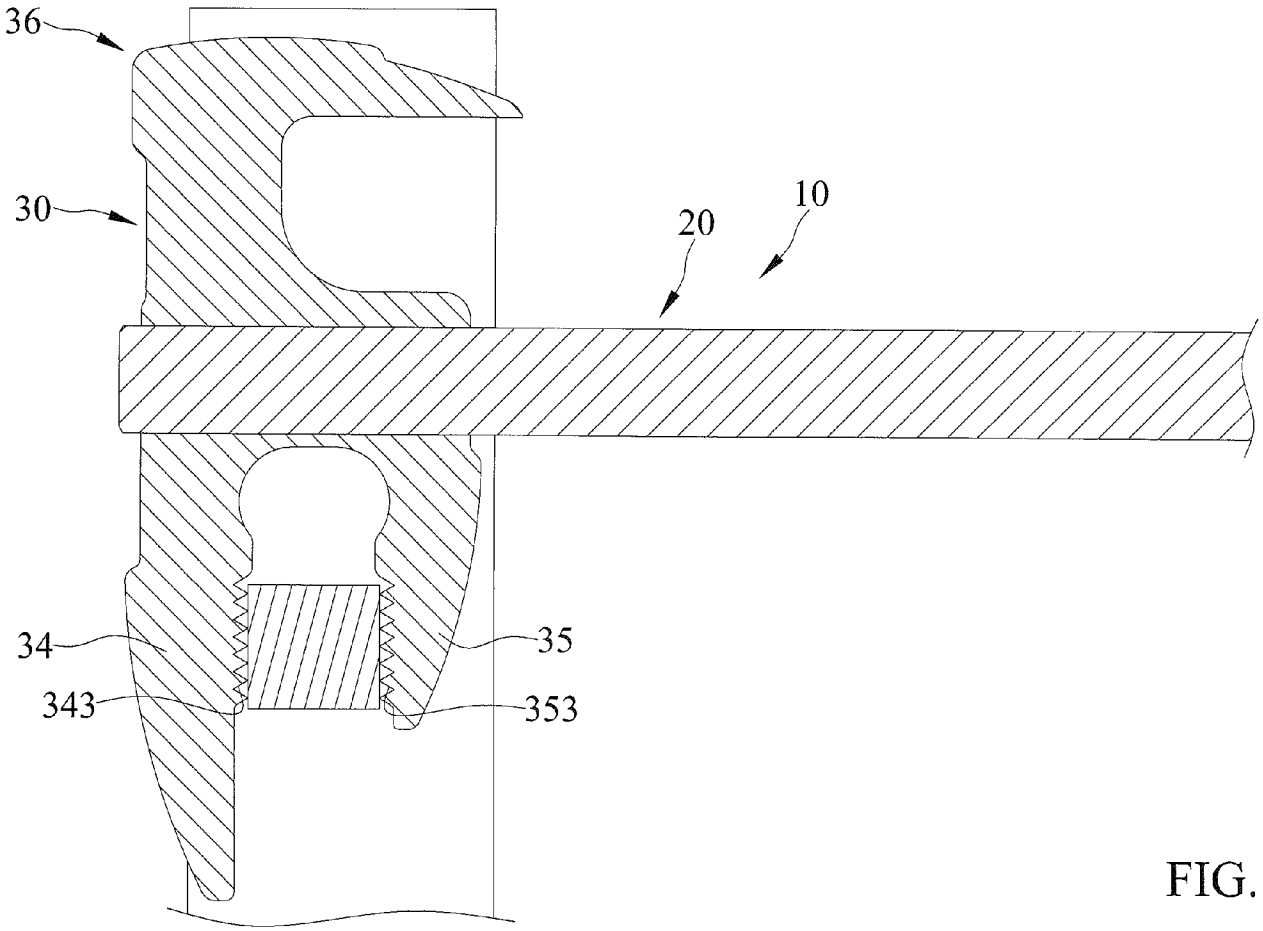
FIG. 7 is a cross-sectional view of FIG. 6.
Figure 8:
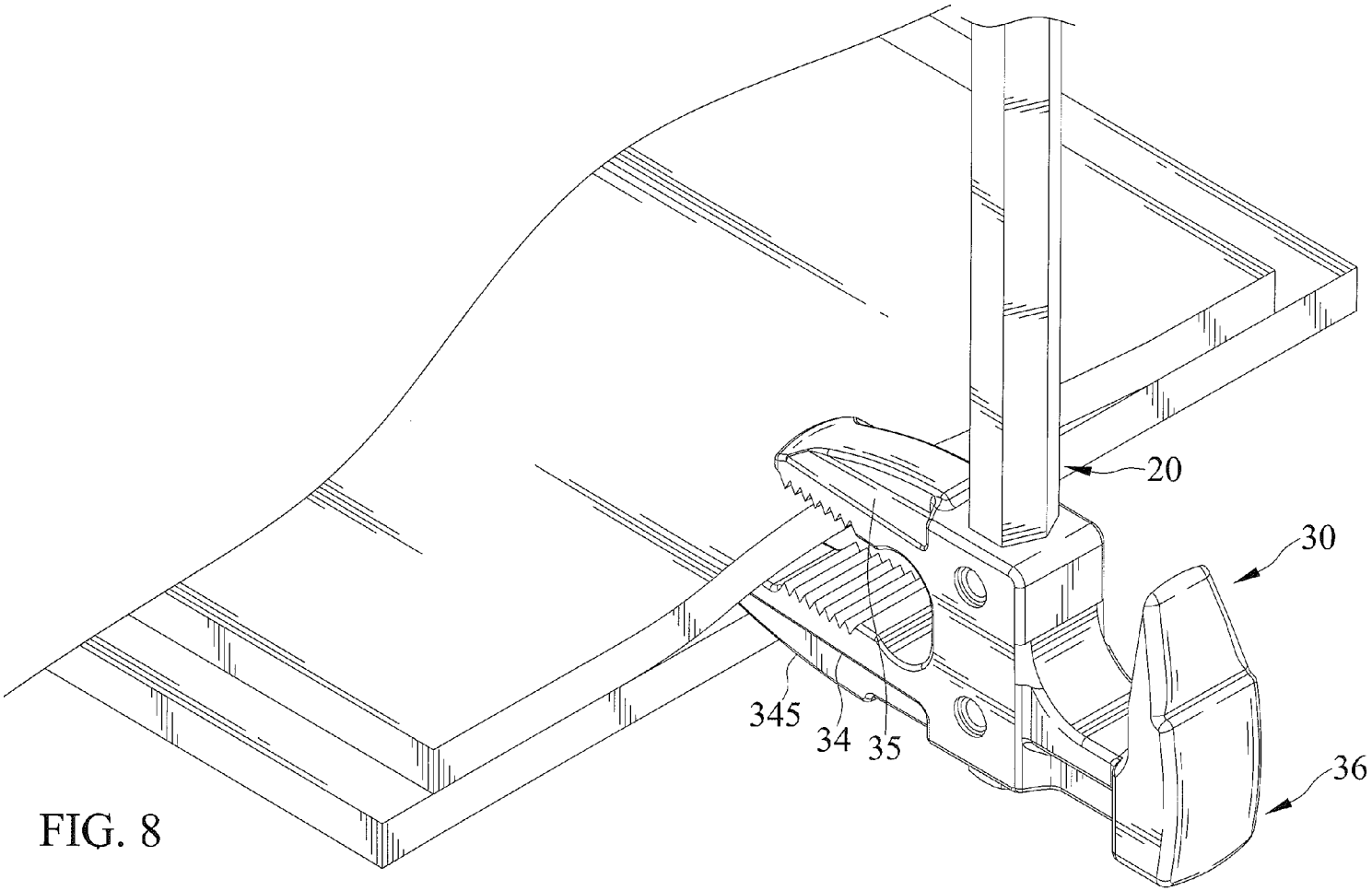
FIG. 8 is a perspective view showing the multifunctional tool of the present invention in a use to separate layers of a laminate.
Figure 9:
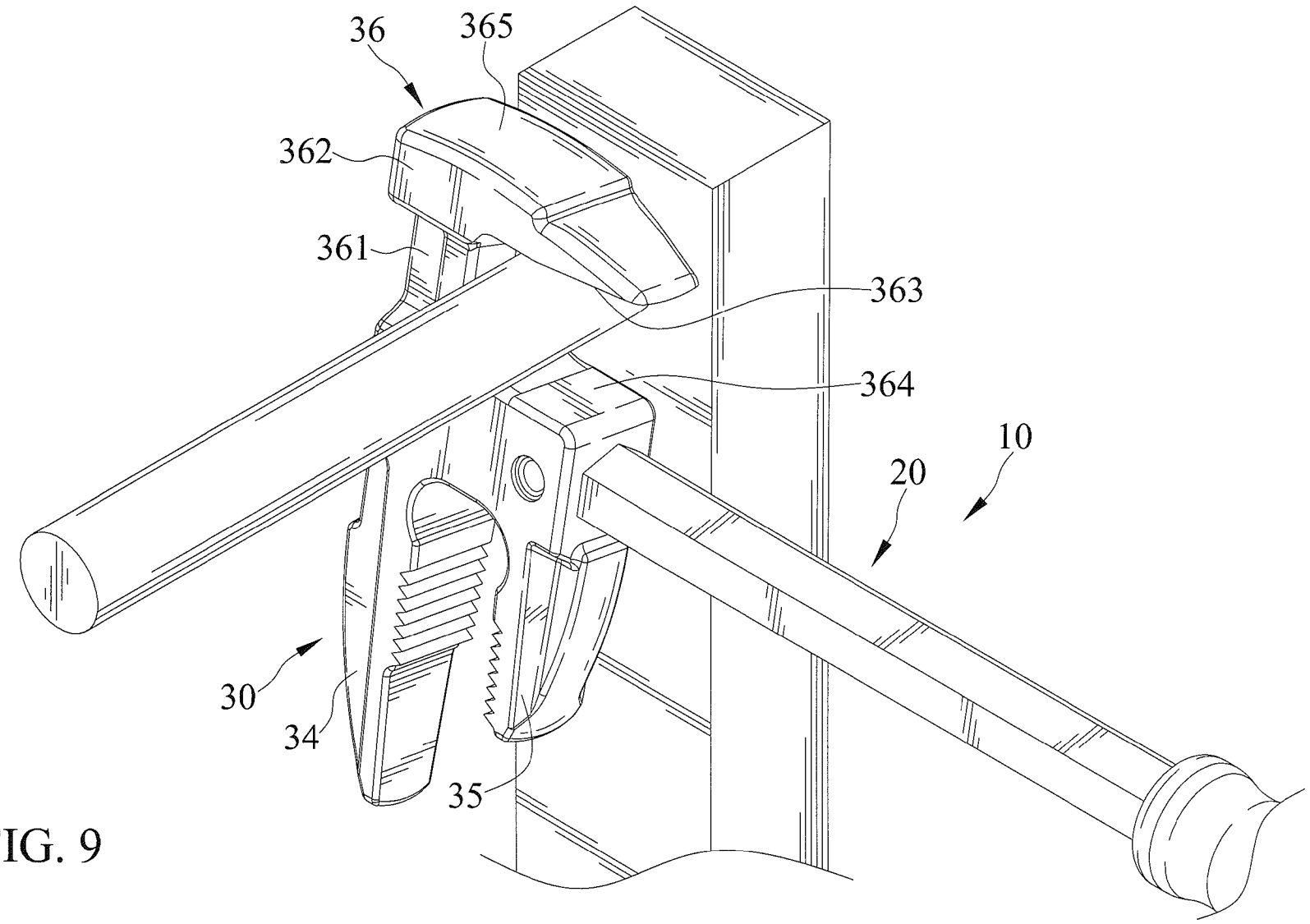
FIG. 9 a perspective view showing the multifunctional tool of the present invention in another use.
Figure 10:
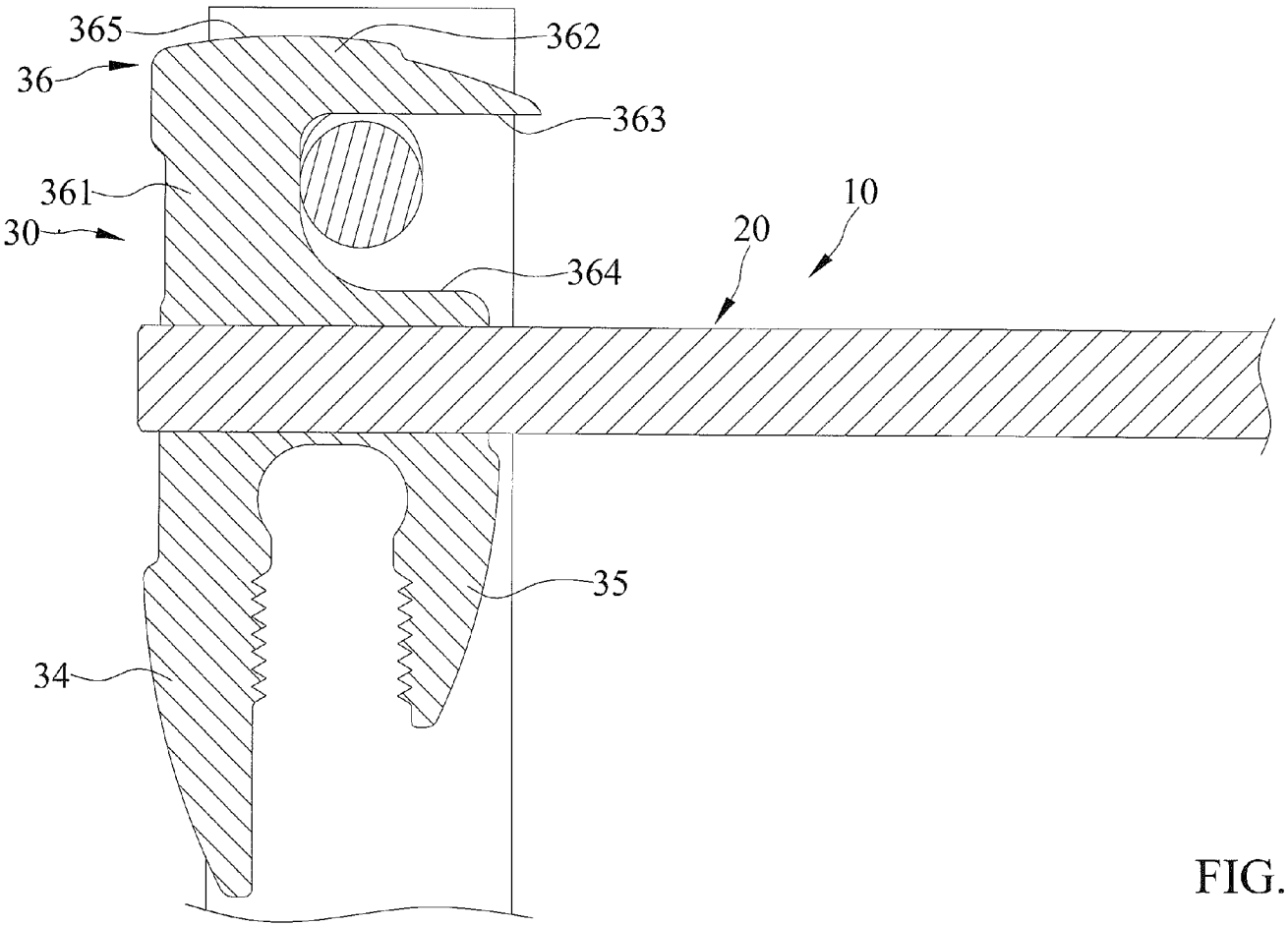
FIG. 10 is a cross-sectional view of FIG. 9.

The multifunctional tool 10 is usable to bend an object. FIGS. 4 and 5 show the multifunctional tool is usable to bend a rebar 90 by the first and second jaws 34 and 35. The rebar 90 is received between the first and second jaws 34 and 35 of the multifunctional tool 10, and particularly, between the first sections 341 and 351 of the first engaging space 37. The multifunctional tool 10 is usable to pry an object, as shown in FIG. 8, by the first jaw 34. The fifth section 345 of the first jaw 34 is used as a fulcrum. The multifunctional tool is usable to pull an object, as shown in FIGS. 9 and 10, by the third jaw 36. The object to be pulled is received in the second engaging space 38. The multifunctional tool 10 is usable to hammer an object, by the protruded area 365. The multifunctional tool 10 is usable to cut and/or pry an object, by the tool end 23, and a driving force can be applied from the working end 21 protruding outside the first end of the connecting hole 31 of the tool head 30.

In view of the forgoing, the multifunctional tool 10 is versatile and can be used as a pry bar or even a survival tool. The multifunctional tool 10 can pry, bend, pull, and hammer an object. The multifunctional tool 10 is designed such that the second length L2 defining the minimum space between the second sections 342 and 352 of the respective first and second jaws 34 and 35 is shorter than the first length L1 defining the maximum space between the first sections 341 and 351 of the respective first and second jaws 34 and 35; the third length L3 defining the minimum space between the third sections 343 and 353 of the respective first and second jaws 34 and 35 is longer than the second length L2 but shorter than the first length L1; and the fourth length L4 defining the space between the first and second surfaces 363 and 364 is not shorter than the third length L3.

The foregoing is merely illustrative of the principles of this invention and various modifications can be made by those skilled in the art without departing from the scope and spirit of the invention.

What is claimed is:

1. A multifunctional tool comprising:

a handle bar, with the handle bar defining a working end; and a tool head connecting to the working end of the handle bar and including a connecting hole extending along a phantom axis and receiving the working end, with the tool head having first and second ends on opposite ends of the phantom axis, with the first end being adjacent to a first jaw and the second end being adjacent to a second jaw respectively, with the first jaw extending away from the phantom axis and along a first phantom line which extends transversely to the phantom axis, with the second jaw facing the first jaw and extending away from the phantom axis and along a second phantom line which extends parallel to the first phantom line and transversely to the phantom axis, with the tool head including a third jaw having a first structure extending away from the phantom axis and along a third phantom line and a second structure extending from the first structure and along a fourth phantom line which extends transversely to the third phantom line, with the tool bead including a first engaging space extending between the first and second jaws and being adjacent to an edge of the first jaw which has first, second, third, and fourth sections disposed one after another along the first phantom line and an edge of the second jaw which has first, second, and third sections disposed one after another along the second phantom line, with the first and second jaws including the respective first sections thereof being adjacent to the phantom axis and facing one another and forming a recess individually, with the first and second jaws including the respective second sections thereof facing one another and forming a flat protrusion individually, with the first and second jaws including the respective third sections thereof facing one another, with the first jaw including the edge thereof having a distal end distal to the phantom axis at a first distance, with the second jaw including the edge thereof having a distal end distal to the phantom axis at a second distance which is shorter than the first distance, with the first engaging space having first, second, and third lengths, with the first length defining a maximum space between the first sections of the respective first and second jaws, with the second length defining a minimum space between the second sections of the respective first and second jaws, with the third length defining a minimum space between the third sections of the respective first and second jaws, with the second length being shorter than the first length, with the third length being longer than the second length but shorter than the first length, with the tool head further including a second engaging space extending between a first surface which is defined on an edge of the second structure of the third jaw and a second surface which faces the first surface, with the second engaging space having a fourth length defining a space between the first and second surfaces, and with the fourth length being not shorter than the third length.

2. The multifunctional tool as claimed in claim 1, wherein the handle bar includes the working end thereof protruding outside a first end of the connecting hole of the tool head.

3. The multifunctional tool as claimed in claim 2, wherein the handle bar includes a longitudinal length protruding outside a second end of the connecting hole of the tool head and including a grip section.

4. The multifunctional tool as claimed in claim 2, wherein the handle bar has another end thereof, which is opposite to the working end, forming a tool end.

5. The multifunctional tool as claimed in claim 4, wherein the tool end includes a wedged structural end.

6. The multifunctional tool as claimed in claim 1, wherein the first and second jaws include the respective first sections thereof having a concave shape, wherein the first and second jaws include the respective second sections thereof being parallel to one another, wherein the first jaw includes the third section thereof forming a serrated protrusion which includes a plurality of teeth disposed one after another along the first phantom line, and wherein the second jaw includes the third section thereof forming a serrated protrusion which includes a plurality of teeth disposed one after another along the second phantom line.

7. The multifunctional tool as claimed in claim 1, wherein the second length is 19 millimeters, wherein the third length is 25 millimeters, and wherein the fourth length is 28 millimeters.

8. The multifunctional tool as claimed in claim 1, wherein the first jaw includes another edge, which is opposite the edge forming the first, second, third, and fourth sections, defining a fifth section extending curvedly along the first phantom line and towards the fourth section in a direction away from the phantom axis.

9. The multifunctional tool as claimed in claim 1, wherein the second structure of the third jaw has another edge thereof, which is opposite to the edge defining the first surface, including a protruded area and a slope extending along the fourth phantom axis and from the protruded area towards the first surface in a direction away from the first structure of the third jaw.

10. The multifunctional tool as claimed in claim 1, wherein the handle bar and the tool head are securely engaged with each other, with handle bar including at least one cavity, with the tool head including at least one protruded joint engaging in the at least one cavity and the connecting hole, and wherein the at least one cavity and the at least one protruded joint extend radially to the phantom axis.

11. A tool head of a multifunctional tool comprising:

a tool head adapted to be connected to a working end of a handle bar, with the tool head including a connecting hole extending along a phantom axis and adapted to receive the working end, with the tool head having first and second ends on opposite ends of the phantom axis, with the first end being adjacent to a first jaw and the second end being adjacent to a second jaw respectively, with the first jaw extending away from the phantom axis and along a first phantom line which extends transversely to the phantom axis, with the second jaw facing the first jaw and extending away from the phantom axis and along a second phantom line which extends parallel to the first phantom line and transversely to the phantom axis, with the tool head including a third jaw having a first structure extending away from the phantom axis and along a third phantom line and a second structure extending from the first structure and along a fourth phantom line which extends transversely to the third phantom line, with the tool head including a first engaging space extending between the first and second jaws and being adjacent to an edge of the first jaw which has first, second, third, and fourth sections disposed one after another along the first phantom line and an edge of the second jaw which has first, second, and third sections disposed one after another along the second phantom line, with the first and second jaws including the respective first sections thereof being adjacent to the phantom axis and facing one another and forming a recess individually, with the first and second jaws including the respective second sections thereof facing one another and forming a flat protrusion individually, with the first and second jaws including the respective third sections thereof facing one another, with the first jaw including the edge thereof having a distal end distal to the phantom axis at a first distance, with the second jaw including the edge thereof having a distal end distal to the phantom axis at a second distance which is shorter than the first distance, with the first engaging space having first, second, and third lengths, with the first length defining a maximum space between the first sections of the respective first and second jaws, with the second length defining a minimum space between the second sections of the respective first and second jaws, with the third length defining a minimum space between the third sections of the respective first and second jaws, with the second length being shorter than the first length, with the third length being longer than the second length but shorter than the first length, with the tool head further including a second engaging space extending between a first surface which is defined on an edge of the second structure of the third jaw and a second surface which faces the first surface, with the second engaging space having a fourth length defining a space between the first and second surfaces, and with the fourth length being not shorter than the third length.

12. The tool head of the multifunctional tool as claimed in claim 11, wherein the first and second jaws include the respective first sections thereof having a concave shape, wherein the first and second jaws include the respective second sections thereof being parallel to one another, wherein the first jaw includes the third section thereof forming a serrated protrusion which includes a plurality of teeth disposed one after another along the first phantom line, and wherein the second jaw includes the third section thereof forming a serrated protrusion which includes a plurality of teeth disposed one after another along the second phantom line.

13. The tool head of the multifunctional tool as claimed in claim 11, wherein the second length is 19 millimeters, wherein the third length is 25 millimeters, and wherein the fourth length is 28 millimeters.

14. The tool head of the multifunctional tool as claimed in claim 11, wherein the first jaw includes another edge, which is opposite the edge forming the first, second, third, and fourth sections, defining a fifth section extending curvedly along the first phantom line and towards the fourth section in a direction away from the phantom axis.

15. The tool head of the multifunctional tool as claimed in claim 11, wherein the second structure of the third jaw has another edge thereof, which is opposite to the edge defining the first surface, including a protruded area and a slope extending along the fourth phantom axis and from the protruded area towards the first surface in a direction away from the first structure of the third jaw.

* * * * *